US006332614B1

(12) United States Patent
Hesse

(10) Patent No.: US 6,332,614 B1
(45) Date of Patent: Dec. 25, 2001

(54) METHOD FOR PLAYING POKER GAMES

(76) Inventor: Michael A. Hesse, 2533 Three Springs Dr., Westlake Village, CA (US) 91361

( * ) Notice: Subject to any disclaimer, the term of this patent is extended or adjusted under 35 U.S.C. 154(b) by 0 days.

(21) Appl. No.: 09/599,972

(22) Filed: Jun. 21, 2000

Related U.S. Application Data

(63) Continuation of application No. 09/175,218, filed on Oct. 19, 1998, now abandoned.

(51) Int. Cl.[7] ..... A63F 1/00
(52) U.S. Cl. ..... 273/292; 273/274
(58) Field of Search ..... 273/274, 292, 273/309; 463/12, 13

(56) References Cited

U.S. PATENT DOCUMENTS 5,294,128 * 3/1994 Marquez .
5,531,441 * 7/1996 Dabrowski et al. .
5,697,614 * 12/1997 Potter et al. .
5,732,950 * 3/1998 Moody .
5,823,873 * 10/1998 Moody .
5,863,041 * 1/1999 Boylan .
5,956,140 * 9/1999 Dabrowski et al. .

* cited by examiner

*Primary Examiner*—William M. Pierce
(74) *Attorney, Agent, or Firm*—Sierra Patent Group Ltd.

(57) ABSTRACT

A method of playing a Poker card game between a Dealer and at least one player is described, having the steps of providing at least one deck of conventional playing cards, requiring each of the at least one player to ante before receiving a hand of cards, dealing cards from said at least one deck to each player and the Dealer so that the Dealer receives two Poker hands and each of said at least one player receives one Poker hand, causing each of the at least one player to execute an option chosen from the following group: to make no bet, to make a bet, evaluating each player hand and each dealer hand after all betting is complete according the standard hand rankings of Poker, determining, based upon said evaluation, the player to be the winner if the player hand is ranked higher than both of said dealer hands, determining, based upon said evaluation, the dealer to be the winner of the hand if either one of the dealer hands are ranked higher than the player hand, causing a winning player to receive an amount of money; and causing a nonwinning player to lose his bet and his ante.

32 Claims, 8 Drawing Sheets

METHOD FOR PLAYING POKER GAMES

This application is a continuation of Ser. No. 09/175,218, filed Oct. 19, 1998, now abandoned.

BACKGROUND OF THE INVENTION

1. Field of the Invention

The present invention relates to gaming and to card games. More particularly, the present invention relate to a method of playing a Poker card game called "EasyPoker" in which a number of players play against one designated player or against a casino or card room ("the house"). The game can also be played electronically in a slot machine or as a computer game.

2. The Background Art

Poker is a very popular card game, played in homes, card rooms, and casinos. There are countless variations of Poker, but they all have certain common features. All players wager equal sums money into a betting pool for that hand called a "pot". Each player then receives a number of cards. There is a round of betting, where players wager money commensurate with how they feel their hand will fare among the hands of other players. Players who feel they have losing hands may instead drop out of the competition ("fold"). Remaining players then often have the opportunity to modify their hands by either replacing cards or adding cards, depending on the „game being played. Another round of betting takes place, followed by another period where players may modify their hands. This scenario may repeat one or more times, depending on the game being played, ending in a period where the hands of players remaining in the game are compared to each other to determine the winner.

In a typical betting round, each player acts in order. If no players have made a bet, the player who is acting typically has the option to make no bet ("pass" or "check") or make a bet. If another player has already made a bet, the player who is acting may match the largest bet made ("call"), match the largest bet and bet more ("raise"), or make no bet and fold. The players continue acting in turn until every player has either called or folded. If, at any time, only one player is left in the game, due to all other players having folded, play terminates at that time, and that remaining player wins the pot.

If more than one player remains in the game after all the hands are complete and all rounds of betting are finished, the winner is determined in a showdown. The players who have not folded reveal the cards in their hand, and all hands are then compared to an ordering sequence. The player whose hand has the best value, according to this ordering sequence, is awarded the "pot").

There are countless variations of Poker, but most of the more popular games fall into three categories: draw, stud, and hold'em.

In a draw game, each player receives five cards, after which is a round of betting. Then each player may replace a number of cards in his/her hand and then there is another round of betting. Finally the hands are compared according to an ordering sequence and the best hand wins the pot.

In a stud game, a player receives one or two cards face down and a card face up, after which there is a round of betting. Then each player receives several more cards one at a time, with a round of betting after each time all the players have receive an additional card. Whether each additional card is dealt face-up or face down is determined by the rules of the variation of stud Poker being played. After all cards have been dealt, and after the final round of betting, all player hands are compared according to a standard Poker ranking system, and the player holding the best hand according the ranking system wins the pot.

In hold'em Poker, the player receives between two and five cards face down, with the number of cards depending on the variation. There is a round of betting after which three cards are dealt face-up in the center of the table. These are "community cards", and each player may use them as part of his/her Poker hand. There is a second round of betting after which a fourth community card is dealt, again face up in the center of the table, followed by a round of betting, a fifth community card, and a final round of betting. Player hands are then ranked according to a standard Poker ranking system, and the player holding the best hand according the ranking system wins the pot.

The forms of pokerdescribed above encompass most variations of poker, but there exists many other variations that fit neatly into these categories.

In Poker, three common methods of choosing a winner are: 1) high hand wins, 2) low hand wins, and 3) high hand and low hand split the pot.

When determining the best high hand, the hands are typically ranked as follows, from best to worst: Five of a kind, Straight flush, full house, flush, straight, three of a kind, two pair, one pair, high card. A flush is when all cards in a hand are the same suit. A straight is when five cards in a hand are contiguous in a sequence from low to high, such as 2, 3, 4, 5, 6, or 7, 8, 9, 10, J. A straight flush is when five cards in a hand are contiguous in a sequence from low to high, and also of the same suit. Three of a kind is when three cards of the same value are in a hand, and a pair is when two cards of the same value are in a hand. Four of a kind is when four cards of the same value are in a hand, and five of a kind is when five cards of the same value are in a hand, either through the use of wild cards, or through the use of a nonstandard deck. A full house is three of a kind, and a pair in the same hand at the same time.

For determining the best low hand, the normal ranking from best to worst is: lowest top card, one pair, two pair, three of a kind, full house. Typically, it does not matter if your hand would make a straight or flush, although there are variations where a straight or flush would count against you.

For games where players having the high hand split the pot with players having the low hand, each player in the game selects the five cards in their hand that make up their best high hand and the five cards in their hand that make up their best low hand. If a player's best high hand is better than any other player's best high hand, that player wins half the pot. If a player's best low hand is better than any other player's best low hand, that player wins half the pot. If a player has the best high hand and the best low hand, that player wins the entire pot.

While Poker is one of the most popular card games played in the United States, it is not one of the more popular and profitable casino games. Several features of Poker make it unattractive to the casual gambler.

First, a person who wants to play must often wait to get a seat in a game. Unlike Blackjack, a new player cannot just find an empty table and sit down and play. There must be at least one other player, and generally several other players to start a game. If there are no empty seats in a current game and there are not enough players waiting to start a new game, a new player must wait. This drawback does not appeal to the casual player, particularly visitors from out of town who have limited time available to play. It also does not appeal to the casino when prospective players are waiting rather than playing. A waiting player does not generate revenue for the casinos.

Second, casino Poker is intimidating for most casual players. There are many complex rules and conventions that the casual player would not be familiar with. There are also many "regulars" in the casino who make money off of the casual player. Conventional Poker requires that you not only play your hand, but you must play the hand against a possibly more skillful opponent. Skillful players are deceptive, making it very difficult for the casual player to know how to play. Since Poker involves a great deal of skill, a player who plays regularly has a large advantage over the casual player. The casual player often feels that he will be "taken" by the regulars in the casino, some of whom play professionally, and he could very well be correct.

While some players love the complexity of Poker, others find it too taxing to be a pleasant form of recreation. Most people who want to have fun do not enjoy waiting to get into a game, and then having to work hard to try to outsmart higher skilled players. Most people are looking for something easier and more readily available.

Blackjack and Baccarat are games which are easy to play, and which are generally more available to play. A player can usually locate an empty seat in a games, and start playing immediately. Since a player in either of these games plays against the house, he does not need to fear the possibility of other players outplaying him.

While many players favor Poker over Blackjack and Baccarat, they find casino Poker unavailable and intimidating.

As a result, casinos have introduced a variety of games that are hybrids of Poker and Blackjack. These hybrids are played against the house like Blackjack, rather than against other players as in Poker. They are much simpler than Poker. However, they use the ranking of hands from Poker as a basis for deciding whether the player wins.

The two most successful hybrid games of this type are "Caribbean Stud" and "Let It Ride."

In Caribbean Stud, the player begins by making a starting bet called the "ante." The player and the dealer then each receive five cards. One of the dealer's cards is dealt face up. After examining his hand and the dealer's exposed card, the player decides whether to make an additional bet of two times the ante or to surrender his ante. All the hands are then turned over. If the dealer's hand is not an Ace-King or better (as Poker hands are ranked), the casino pays the player the amount of his ante. If the dealer's hand is at least Ace-King, the player's hand and the dealer's hand are compared. If the dealer's hand is better, the player loses his ante and his bigger bet. If the player's hand is better, the player wins the amount of his ante and the amount of his additional bet. If the player makes two pair or better the player wins more. For example, if the player makes two pair the player wins twice his additional bet. If the player makes three of a kind, he wins three times his additional bet. The player can win up to 100 times his bet with a Royal Flush. A Royal Flush is a hand of cards having 10, J, Q, K, A, all in the same suit.

In the game "Let It Ride", a player starts by placing three equal bets in front of him after which he then receives three cards. The player has the option to take one of his bets back or leave all three bets in play. The player then is given a fourth card and a community card is dealt face up. (All players at the table may use the community card as part of their hand.) The player again has the option to remove one of his bets. At this point the player has 1, 2, or 3 bets in play. Finally, the player receives a fifth card, and a second community card is dealt face up on the table. The player is then allowed to make the best possible Poker hand from the combination of his five cards and the two community cards. If the player makes a good enough hand, the casino pays off based on a payment schedule similar to that of video Poker. With less than a pair of tens, the player loses his wager. With a pair of tens through a pair of aces, the player wins the amount of his remaining wagers. With two pair, the player wins twice the value of each of his wagers. The payments scale upwards to a maximum of 1,000 times each of his wagers for achieving a Royal Flush.

Neither of these two games, "Caribbean Stud" and "Let it Ride", is Poker. While they use the hand rankings of Poker, the player does not bet, raise, or check as in conventional Poker. Neither game follows the format of five-card draw, five-card stud, seven-card stud, Texas hold'em or any other conventional Poker game. The cards are not dealt or revealed in the same manner as Poker, and these games do not have the same sequence of bets. In many respects the two games are closer to video Poker slot machines than table Poker.

OBJECTS AND ADVANTAGES OF THE INVENTION

It is an object of the present invention to provide an enjoyable card game.

It is a further object of the present invention to provide a method of playing Poker games that allows a player to play when there are no other players.

It is a further object of the present invention to provide a game that will be familiar to current Poker players and easy for them to learn.

It is a further object of the present invention to provide a game that could be played in a slot machine, a table game, or as a computer game.

SUMMARY OF THE INVENTION

A method of playing a Poker card game between a Dealer and at least one player is described, having the steps of providing at least one deck of conventional playing cards, requiring each player to ante, dealing cards from at least one deck to each player and the Dealer so that the Dealer receives two Poker hands and each of the players receive one Poker hand, permitting each of the at least one player to either check, bet, or raise, evaluating each player hand and each dealer hand after all betting is complete according the standard hand rankings of Poker, determining, based upon said evaluation, the player to be the winner if the player hand is ranked higher than both of said dealer hands, determining, based upon the evaluation, the dealer to be the winner of the hand if either one of the dealer hands are ranked higher than the player hand, causing a winning player to receive an amount of money, and causing a nonwinning player to lose his bet and his ante.

DETAILED DESCRIPTION OF A PREFERRED EMBODIMENT

Figure 1:
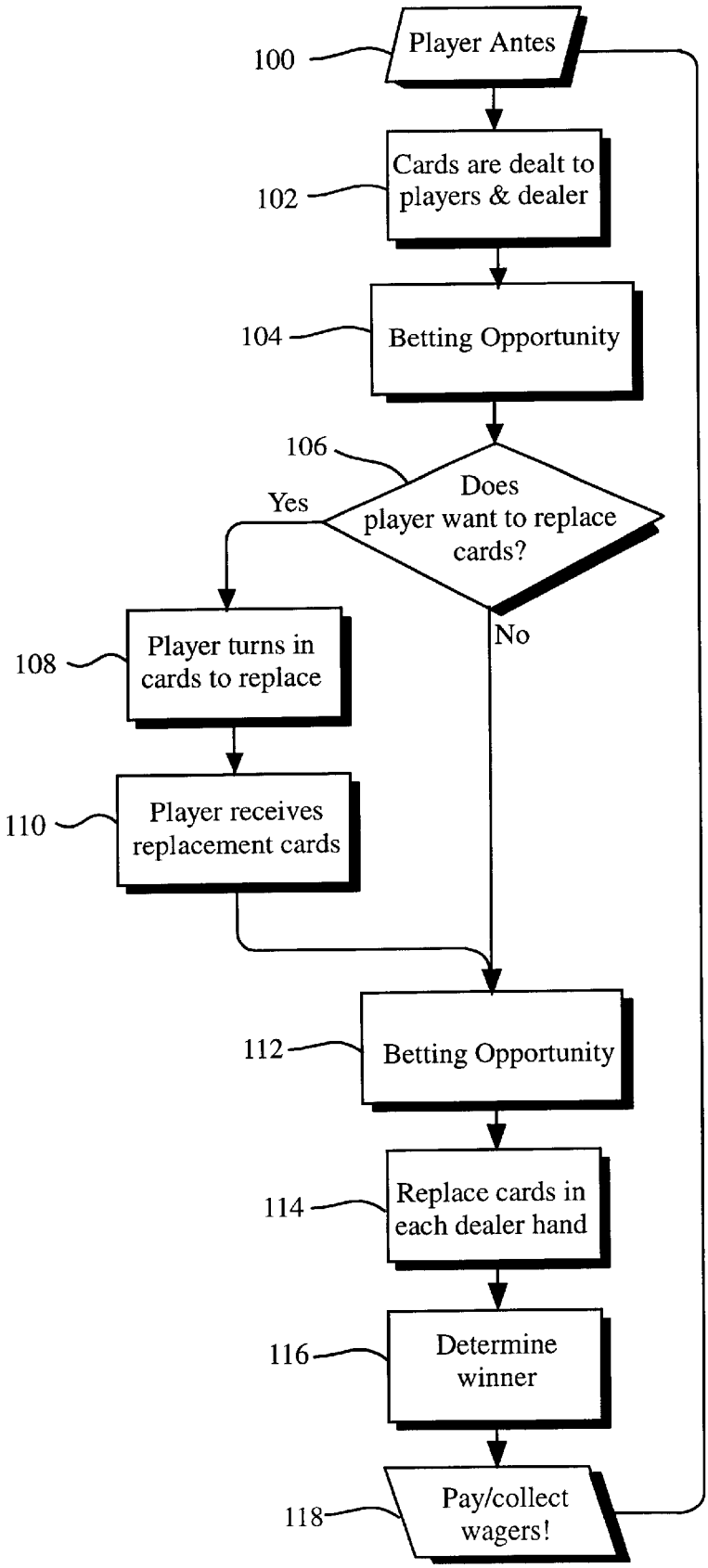
FIG. 1 is a flow chart of how to play draw Poker according to a presently preferred embodiment of the present invention.

Those of ordinary skill in the art will realize that the following description of the present invention is illustrative only and not in any way limiting. Other embodiments of the invention will readily suggest themselves to such skilled persons.

In this specification, reference is made to male pronouns such as "he" and "him". It is not intended that these terms be gender specific. Rather, any such terms are meant to refer to both male and female persons.

According to a presently preferred embodiment of the present invention, players play against a casino. However, in jurisdictions where such games are not legal, such as in California, one player may be designated "Player-Dealer" and all the other players would play against the Player-Dealer. The option to act as Player-Dealer would be offered to each player in turn. In this specification, the term "Dealer" is intended to refer to either a casino dealer, or a Player-Dealer, whichever is appropriate for the circumstances under which the game of the present invention is played.

The presently preferred embodiment of the present invention, EasyPoker, is played with one or more regular decks of playing cards, each deck having 13 cards in each of four suits. However, alternative embodiments are contemplated that EasyPoker could be played using a nonstandard deck of cards having more or less than four suits, and more or less than 13 cards in each suit. Further, although a presently preferred embodiment of EasyPoker utilizes the standard ranking of hands found in the game of Poker, it is contemplated by the inventor that a nonstandard ranking of hands may also be developed, without departing from the scope or purpose of the present invention. According to a presently preferred embodiment, jokers are not utilized, although they could be used as wildcards in variations of the game according to the present invention.

The play of EasyPoker according to the present invention may be easily understood with reference to FIGS. 1 through 7, which comprise flow charts illustrating the progress of the game.

For the purposes of this specification, a betting opportunity is defined as an opportunity for each player to check, bet, or raise. In the presently preferred embodiment, if a player checks, he makes no additional bet at that time. In an alternate embodiment contemplated by the inventor, if a player checks during a betting opportunity, his betting for the entire hand is complete. He will continue to play receive or replace cards and may win his/her wager, but may make no further increases in his wager.

If, in a presently preferred embodiment of the present invention, a player bets during a betting opportunity, he makes a bet equal to the ante. In an alternate embodiment contemplated by the inventor, if a given player does not raise at a betting opportunity, that player may not raise at subsequent betting opportunities for the same hand. If a player raises, he makes a wager equal to some integer multiple of his ante. In one embodiment, the player may make a raise up to three times his original ante, while in another embodiment, he may make a raise up to five times the value of the ante. Yet another embodiment is contemplated where the size of the bets allowed changes for each betting opportunity. For example, the player may be allowed to bet up to twice his ante during the first two betting opportunities and up to three times his ante during subsequent betting opportunities.

In conventional Poker, each player must, in a round of betting, respond to the other players' bets and raises; and if there are raises, the player may have to act more than once in a round. In EasyPoker, the player does not take the actions of the other players into account when betting. The EasyPoker player is only required to decide whether to increase his own bet. This is because, unlike conventional Poker, the EasyPoker player is competing with the house or Player-Dealer, rather than with other players at the table.

Within this disclosure, the term "wager" shall refer to bets made by a player on his hand, including his ante. However, it is contemplated that alternative embodiments of the present invention may include variations where the ante and bets made subsequent to the ante are treated differently.

FIG. 1 is a flow chart of how to play draw Poker according to a presently preferred embodiment of the present invention.

Referring to FIG. 1, at step 100, each player makes an initial wager known to those of ordinary skill in the art as an ante. In a presently preferred embodiment of the present invention, this ante is a fixed value set by the house. In an alternate embodiment contemplated by the inventor, the ante may be different for each player, within the betting limits set for the particular table.

At step 102, the dealer deals to each player a hand of five cards, and deals himself two hands of five cards each. The deal usually begins with the player to the left of the dealer receiving the first card, the deal progressing clockwise with each player and the dealer receiving cards in succession, with the dealer treating himself as two players for the purposes of the deal. When the deal is complete, each player has five cards and the dealer, representing two players for the purposes of the deal, has two hands of five cards each.

At step 104, each player has a "betting opportunity". As described earlier, at a betting opportunity, a player has the opportunity of checking, betting, or raising.

At step 106, each player decides whether to replace cards in his hand, and if so, how many to replace. If the player decides to replace cards, at step 108, the player discards from his hand the card he desires to replace. At step 110, the player receives cards from the dealer to replace those that were discarded.

At step 112, each player has another betting opportunity.

At step 114, the Dealer replaces cards according to a set of rules established by the house. One such possible set of rules will be discussed later, in our discussion of FIGS. 6 and 7.

At step 116, the hands of all players and the dealer are turned face up on the table, and then ranked according to standard ranking of Poker hands known to those of ordinary skill in the art. Alternatively, a nonstandard ranking of hands may be used, without departing from the scope or purpose of the present invention.

At step 118, players are paid or wagers collected by the dealer, depending on the outcome of step 116. If a given player has been determined to have a higher ranked hand than either of the dealer hands, the dealer pays the player an amount equal to the player's total wager. If it is determined that either one of the two dealer hands are ranked higher than a given player hand, the wager corresponding to that particular player is collected by the dealer. If the player chooses to play again, play resumes at step 100. An alternative embodiment contemplated by the inventors provides for a "low hand wins" game. Thus, if the dealer has a lower ranked hand then a player, the dealer wins. Otherwise, the player wins.

If, at step 106, the player decided not to replace any cards in his hand, play continues at step 112.

It is obvious to those of ordinary skill in the art that steps 112 and 114 could be reversed, and that the Dealer could replace cards in the Dealer hands before the second betting opportunity.

Figure 2:
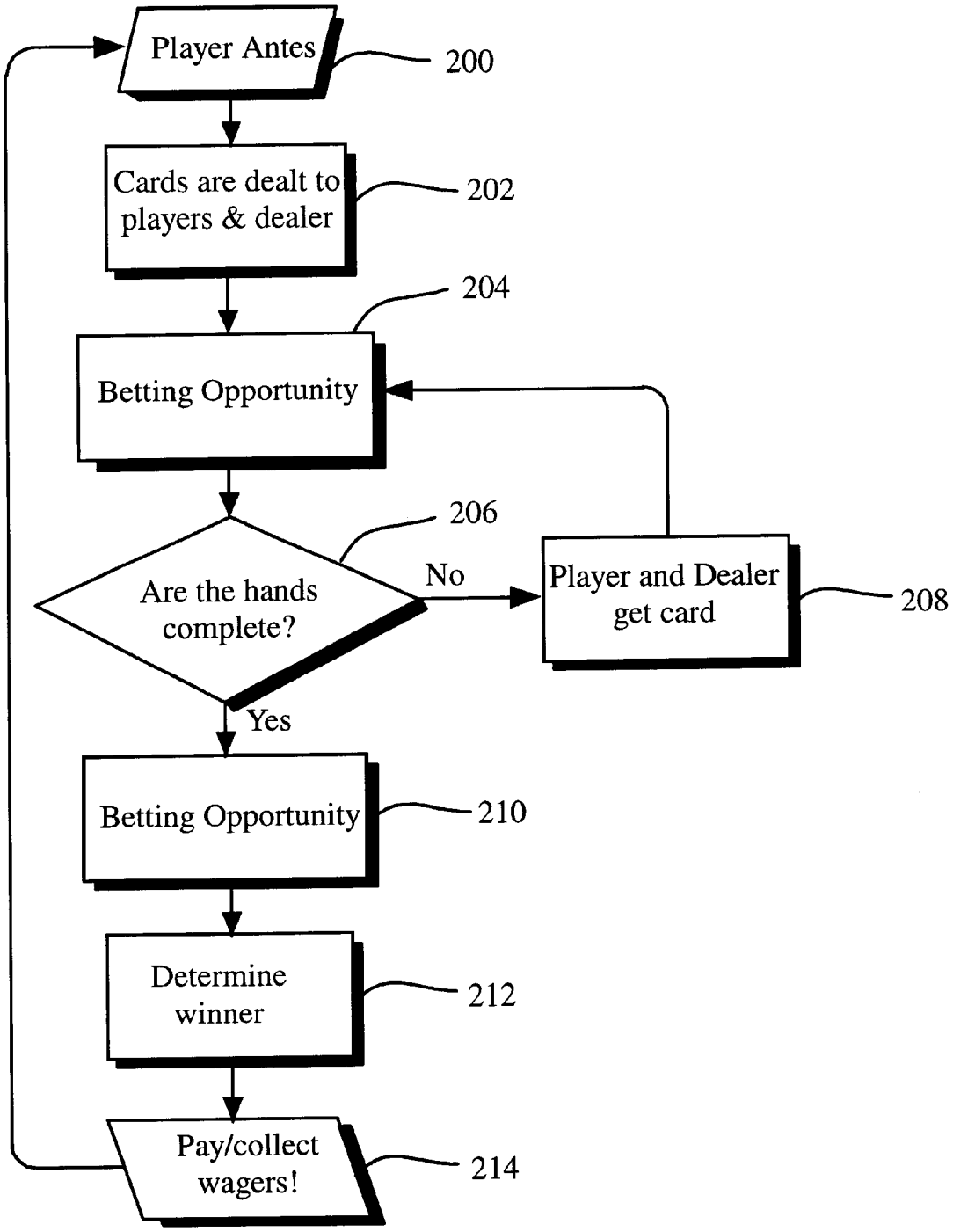
FIG. 2 is a flow chart of how to play stud Poker according to a presently preferred embodiment of the present invention.

FIG. 2 is a flow chart of how to play Stud Poker according to a presently preferred embodiment of the present invention.

Referring to FIG. 2, the method presented herein applies to, but is not limited to, the Poker games of 5-card stud, 7-cards stud, razz (7-card stud low), and 7-cards stud high/low split.

Referring now to FIG. 2, the method of FIG. 2 begins at step 200 when each player antes.

At step 202, each player receives a hand from the dealer consisting of one or more cards face down and one card face up. Once again, the deal usually begins with the player to the left of the dealer receiving the first card, the deal progressing clockwise with each player and the dealer receiving cards in succession, with the dealer treating himself as two players for the purposes of the deal. However, the deal may progress clockwise or counterclockwise, without departing from the scope or purpose of the present invention.

At step 204, each player is given a betting opportunity. As described earlier, at a betting opportunity, a player has the opportunity of checking, betting, or raising. All previously described embodiments involving betting opportunities are available at this time.

At step 206, it is determined whether all the hands are complete, depending on the variation of stud EasyPoker being played. We previously stated that the method of FIG. 2 may be played by adapting conventional Poker variations such as 5-card stud, 7-cards stud, razz (7-card stud low), and 7-cards stud high/low split. In the 5-card variations, a player must have 5 cards in order for his hand to be complete. Correspondingly, in the 7-card variations, a player must have 7 cards in order for his hand to be complete. The dealer has two hands, as stated earlier, and the players play against the dealer, rather than against themselves.

If, at step 206, the hands of one or more players are determined to be incomplete, the method proceeds with step 208, where each player hand and each Dealer Hand receives an additional card. At step 210, each player has a betting opportunity, which as described earlier, gives the player an opportunity to check, bet, or raise. All previously described embodiments and variations available at a betting opportunity are also available here.

If, at step 206, all player hands are determined to be complete, the method proceeds with step 210 at which time there is another betting opportunity.

Following the betting opportunity of step 210, the method proceeds with step 212 during which the hands of all players and the dealer are turned face up on the table, and the winner between each player and the dealer is determined by ranking player and dealer hands according to the standard ranking of Poker hands known to those of ordinary skill in the art. If the player has the higher ranked hand as compared to the two dealer hands, the player wins. Otherwise, there either is a tie, or dealer wins. Alternatively, a nonstandard ranking of hands may be used, without departing from the scope or purpose of the present invention. A high/low game or a "low hand wins" game may also be played, as previously described.

At step 214, players are paid or wagers collected by the dealer, depending on the outcome of step 212. If a given player has been determined a winner, the dealer pays the player an amount equal to the total wager amount. If the dealer is determined to be the winner with respect to a given player, the wager corresponding to that particular player is collected by the dealer. If one or more players choose to play again, play resumes at step 200.

Figure 3:
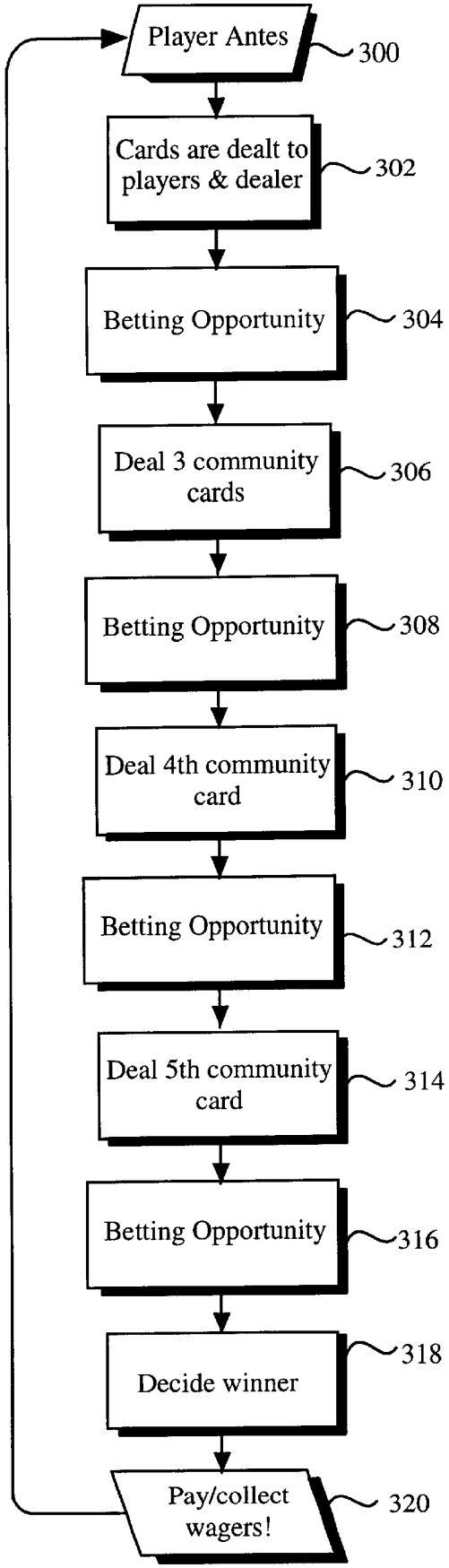
FIG. 3 is a flow chart of how to play hold'em Poker according to a presently preferred embodiment of the present invention.

FIG. 3 is a flow chart of how to play hold'em Poker according to a presently preferred embodiment of the present invention.

Hold'em Poker is a category of Poker which typically includes games such as Texas hold'em, Texas hold'em high/low, Omaha, Omaha high/low, Pineapple, and Pineapple high/low.

Referring now to FIG. 3, the method begins at step 300, during which each player antes.

At step 302, each player receives a hand from the dealer consisting of two or more cards face down. Once again, the deal usually begins with the player to the left of the dealer receiving the first card, the deal progressing clockwise with each player and the dealer receiving cards in succession, with the dealer treating himself as two players for the purposes of the deal. When the deal is complete, each player has two or more cards and the dealer, representing two players for the purposes of the deal, has two hands of two or more cards each.

At step 304, each player is given a betting opportunity. As described earlier, at a betting opportunity, a player has the opportunity of checking, betting, or raising. All previously described embodiments involving betting opportunities are available at this time.

At step 306, three community cards are dealt face up. These community cards, as well as any other community cards described herein, are cards which may be concurrently used by any and all players, and the dealer.

At step 308, each player gets a betting opportunity having the same options for a player as seen in step 304. All previously described embodiments involving betting opportunities are available at this time.

At step 310, a fourth community card is dealt, face up, on the table.

At step 312 each player gets a betting opportunity having the same options as seen at step 304. All previously described embodiments involving betting opportunities are available at this time.

At step 314, a fifth community card is dealt, face up, on the table. At step 316, each player gets a final betting opportunity having the same options as seen at step 304. All previously described embodiments involving betting opportunities are available at this time.

The method proceeds with step 318 during which the hands of all players and the dealer are turned face up on the table, and the winner between each player and the dealer is determined by ranking the best hands of each player individually against the best hand held by the dealer according to one of the standard rankings of Poker hands known to those of ordinary skill in the art. The hand of each player is compared to the two hands held by the dealer. Players are individually determined winners and losers, according to the rank of their hand as compared to the dealer's hands.

Alternatively, a nonstandard ranking of hands may be used, without departing from the scope or purpose of the present invention. A high/low game may be played using the method of FIG. 3, without departing from the scope or purpose of the present invention.

At step 320, players are paid or wagers collected by the dealer, depending on the outcome of step 318. If a given player has been determined a winner, the dealer pays the player an amount equal to the total wager amount. If the dealer is determined to be the winner with respect to a given player, the wager corresponding to that particular player is collected by the dealer. If one or more players choose to play again, play resumes at step 300.

Figure 4:
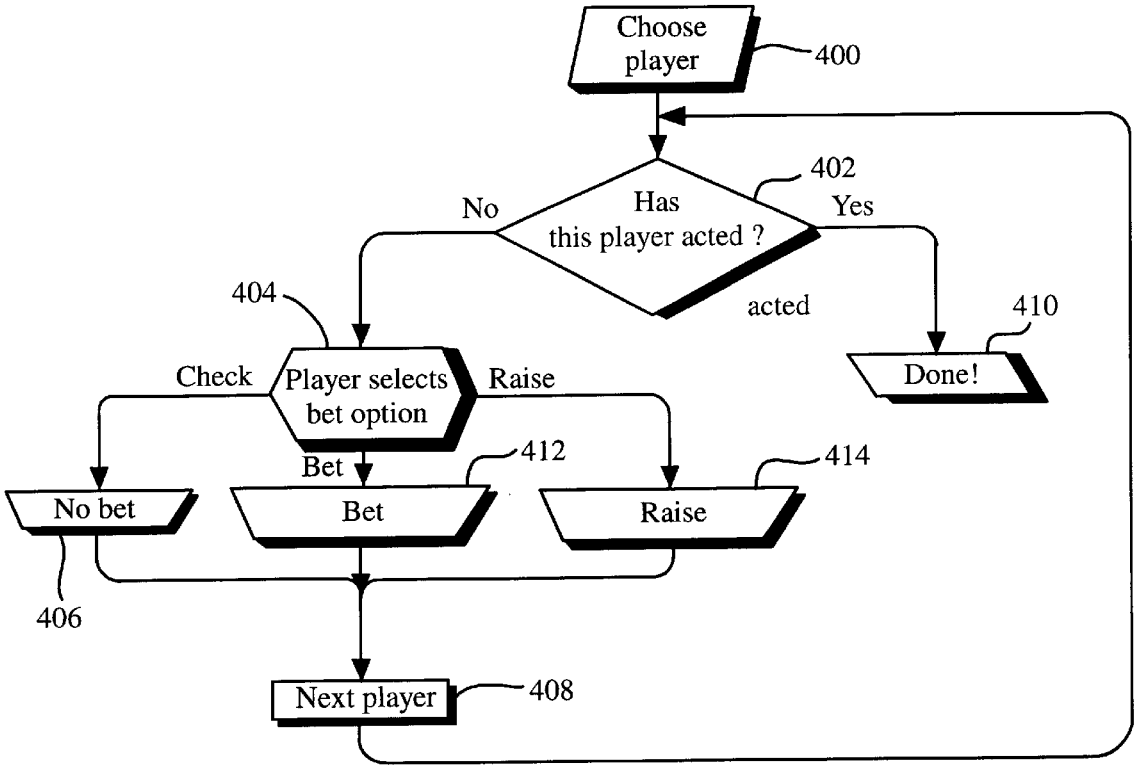
FIG. 4 is a flow chart of a betting opportunity according to a presently preferred embodiment of the present invention.

FIG. 4 is a flow chart of a betting opportunity according to a presently preferred embodiment of the present invention.

The method described herein is intended to detail preferred steps in the method of the present invention whenever a betting opportunity is presented to a player such as in steps 104 and 112 of FIG. 1, steps 204 and 210 of FIG. 2 and steps 304, 308, 312, and 316 of FIG. 3, all methods of the present invention.

For the purposes of describing the method of FIG. 4, the term "act" is defined as a "check", "bet", or "raise". Thus, if a player has a chance to act, he is allowed to check, bet, or raise at that time.

Referring now to FIG. 4. the method begins at step 400, where a player is given a betting opportunity. Typically, betting opportunities are given in rotation, in a similar manner as was seen for dealing. The Player to the left of the dealer usually has the opportunity to bet first, followed in succession by each other player, clockwise around the table until each player has had a betting opportunity. However, it is not necessary to perform the betting in this manner in order to remain within the scope and spirit of the present invention. Rather, any method of allowing players a betting opportunity is acceptable, so long as each player at the table has had a betting opportunity prior to play proceeding.

At step 402, it is determined if this player has already had an opportunity to act during this particular betting opportunity. This step is used to determine whether the chance to check, place a bet, or raise has progressed all around the table, back to the player on the immediately left of the dealer, by determining whether current player is a player who has already had a chance to bet during this step.

If, at step 402, it was determined that the current player has not yet had an opportunity to act, the player chooses a bet option at step 404 from the three options of check, bet, or raise.

If the player chooses to check, at step 406, the player makes no bet, and play proceeds with step 408, at which time a new player is selected to have a betting opportunity. Recall that it is conventional to have the betting opportunity rotated, beginning with the player to the immediate left of the dealer, rotating clockwise through all players, until each player has had the opportunity to bet. However, any acceptable and fair method for choosing which player is the next to have a betting opportunity may be used without departing from the scope and purpose of the present invention.

After a new player is chosen at step 408, the method proceeds again with step 402.

If, at step 402, it is determined that a player has already had a betting opportunity, the method terminates at step 410, where play proceeds with the next step in the method that originated the betting opportunity.

If, at step 404, the player desires to bet instead of check or raise, play proceeds, at step 412, with the player making a bet that falls within the rules of the establishment where the game is being played. Recall that a normal bet will usually be equal to the ante. However, it may also be a multiple of the ante as previously described herein.

Once a bet is made, at step 412 according to the rules of the establishment where the game is being played, the method proceeds with step 408 as previously described.

If, at step 404, the player desires to raise instead of check or bet, play proceeds, at step 414, with the player raising his bet to an amount that falls within the rules of the establishment where the game is being played. Recall that a normal bet will usually be equal to the ante. Thus, a raise will be a higher bet, usually a multiple of the ante. In establishments which have a multiple of the ante being the minimum bet, the raise will be a higher multiple of the ante.

Once a raise is made, at step 414, according to the rules of the establishment where the game is being played, the method proceeds with step 408 as previously described.

An alternative embodiment contemplated by the inventor inserts a step 404*a* (not shown) between steps 402 and 404. At this step, it is determined whether the player having the current betting opportunity has "checked" at any time during this hand. That is, it is determined whether the player is decided to "no bet" at any time during the current hand. If so, the method proceeds to step 406, and that player is not allowed to increase his bet.

If, at the new step 404*a,* it is determined that the player having, the current betting opportunity has not checked at any time during this hand, the method proceeds with step 404, and the player is given the opportunity to check, bet, or raise.

Figure 5:
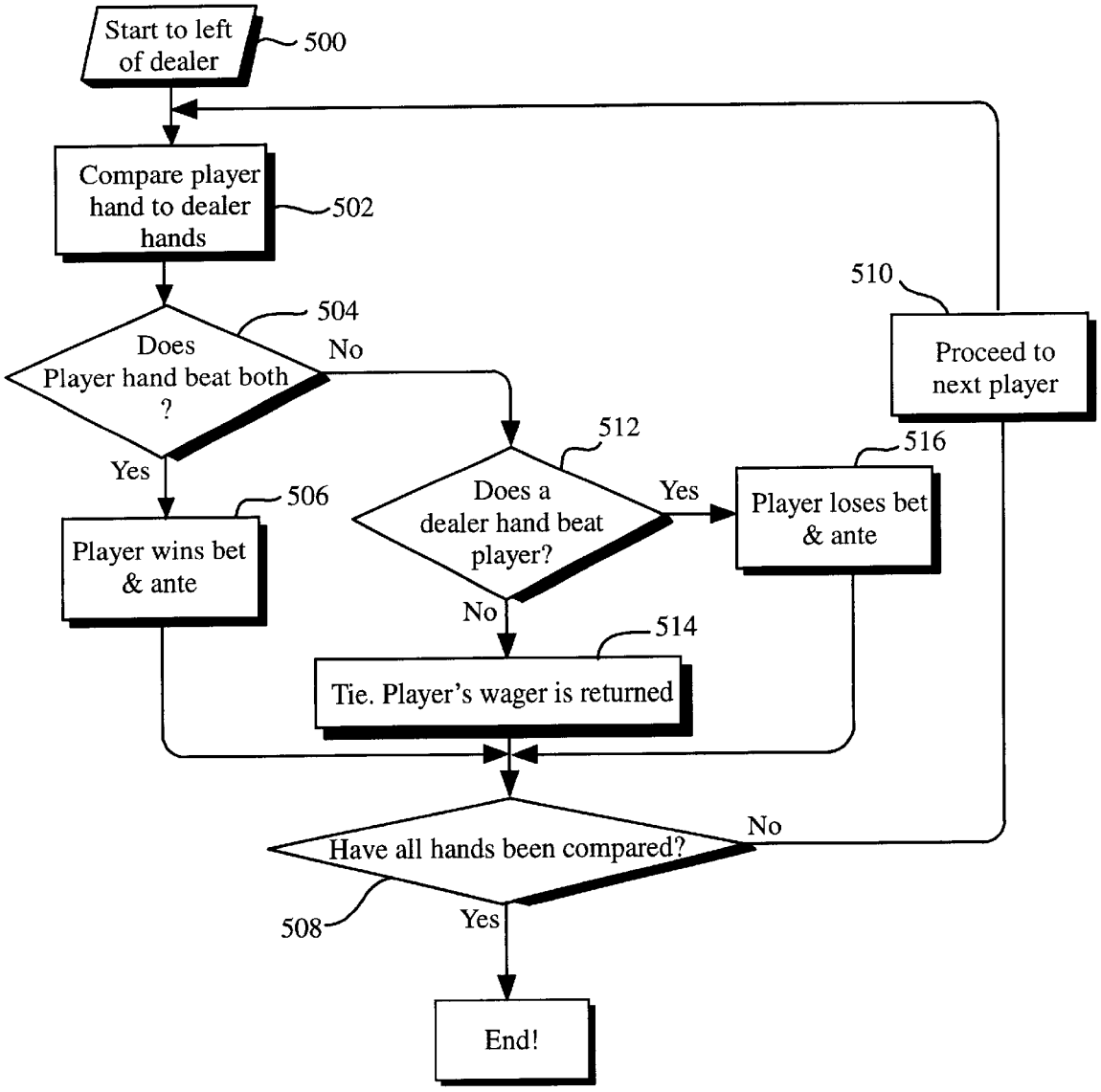
FIG. 5 is a flow chart of the method of deciding winners and awarding money to them according to a presently preferred embodiment of the present invention.

FIG. 5 is a flow chart of the method of deciding winners and awarding money to them according to a presently preferred embodiment of the present invention.

The method of FIG. 5 described herein is intended to detail preferred steps in the method of the present invention whenever it is necessary to determine which players are winners in a hand of EasyPoker, such as seen in steps 116 of FIG. 1, 212 of FIG. 2 and 318 of FIG. 3.

Referring now to FIG. 5. the method begins with step 500, at which time a player hand is chosen for evaluation. As previous discussed, it is most conventional to choose the player hand on the left hand of the dealer for evaluation, then rotate clockwise, evaluating wins and losses, until all hands have been evaluated. However, any fair method may be used, without departing from the scope or purpose of the present invention.

At step 502, a comparison is made between the player hand and the two dealer hands, according to a standard ranking of Poker hands known to those of ordinary skill in the art. Alternatively, the establishment sponsoring the game may establish other nonstandard rankings.

At step 504, it is determined whether the player hand beats both of the dealer hands. If it is determined that the player hand beats both dealer hands, the dealer awards that player, at step 506, the amount of the player's ante and all other wagers the player has made on his hand.

The method then proceeds with step 508, where it is determined if all player hands have been compared to the two dealer hands. If no, the method proceeds with step 510, during which another player hand is chosen for comparison. After choosing another player hand for comparison with the dealer hands, the method proceeds again with step 502 as previously described.

If, at step 504, it was determined that the player's hand is not better than both Dealer's hands, the method proceeds with step 512, where it is determined whether either Dealer hand beats the player hand. If no, the player and the dealer have tied, and, at step 514, the dealer returns the players'wager, including the ante. The method then proceeds with step 508 as previously described.

If, at step 512, it is determined that a Dealer hand is ranked higher than the player hand, the dealer collects the player ante and subsequent bets. The method then proceeds with step 508 as previously described.

If, at step 508, it was determined that all player hands have been compared, this method ends, and play resumes with the proper step in the method being executed.

An alternative embodiment contemplated by the inventor modifies step 506 of FIG. 5 to cause only subsequent player bets which follow the ante to be considered wagers when payouts are determined. Thus, if the player hand beats both dealer hands, the player receives from the dealer, an amount equal to his subsequent wagers, and gets his ante back, but never receives additional money from the dealer representing a win on an ante wager.

Figure 6A:
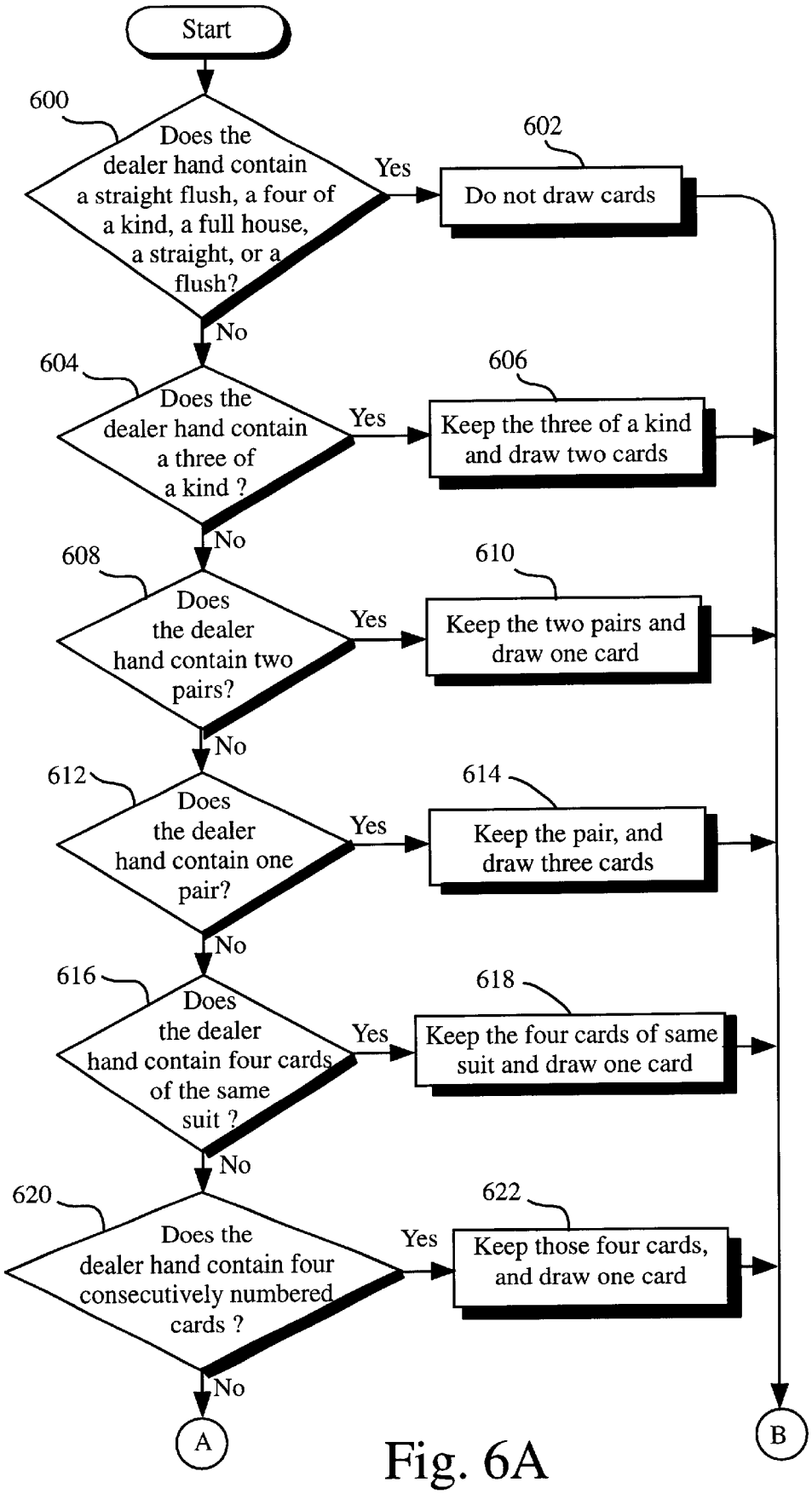
FIGS. 6A and 6B collectively comprise a flow chart showing steps in a preferred method for determining the number of cards to be drawn by the dealer when the object of a game is to have a high hand.
Figure 6B:
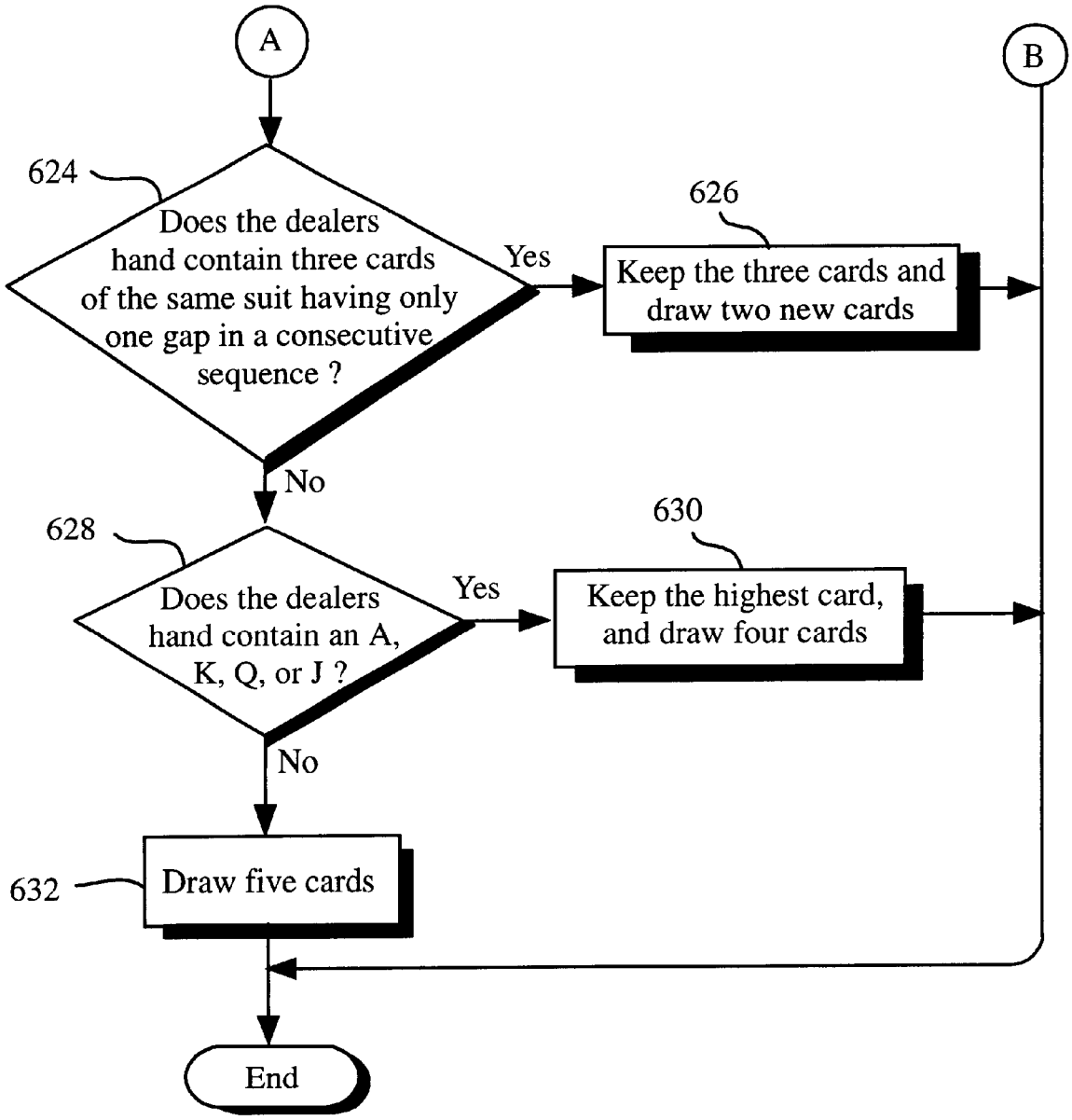

FIGS. 6A and 6B collectively comprise a flow chart showing steps in a preferred method for determining the number of cards to be drawn by the dealer when the object of a game is to have a high hand.

Referring to FIG. 6A, the preferred method of the present invention begins at step 600 when the dealer hand being evaluated is examined to determine whether it contains any of a straight flush, four of a kind, a full house, a straight, or a flush. If yes, the method proceeds at step 602 with a decision to not have the dealer draw any cards for that hand. Following step 602, the evaluation of the hand is complete, and the method ends.

If, at step 600, none of the recited hands are present in the dealer hand being evaluated, the method proceeds with step 604 when it is determined if the dealer hand being evaluated contains three of a kind. If yes, the method proceeds with step 606 during which the three of a kind is retained, the remaining two cards discarded, and two new cards drawn, completing a new hand. Following step 606, the evaluation of the hand is complete, and the method ends.

If, at step 604, the dealer hand being evaluated does not contain a three of a kind, the method proceeds with step 608 during which it is determined if the dealer hand being evaluated contains two pair. If yes, the method proceeds with step 610 during which the two pair are retained, the remaining card is discarded, and one new card drawn, completing a new hand. Following step 610, the evaluation of the hand is complete, and the method ends.

If, at step 608, the dealer hand being evaluated does not contain two pair, the method proceeds with step 612 during which it is determined if the dealer hand being evaluated contains one pair. If yes, the method proceeds with step 614 during which the pair is retained, the remaining three cards are discarded, and three new cards drawn, completing a new hand. Following step 614, the evaluation of the hand is complete, and the method ends.

If, at step 612, the dealer hand being evaluated does not contain a pair, the method proceeds with step 616 during which it is determined if the dealer hand being evaluated contains four cards of the same suit. If yes, the method proceeds with step 618 during which the four cards are retained, the remaining card is discarded, and one new card drawn, completing a new hand. Following step 618, the evaluation of the hand is complete, and the method ends.

If, at step 616, the dealer hand being evaluated does not four cards of the same suit, the method proceeds with step 620 during which it is determined if the dealer hand being evaluated contains four consecutively numbered cards. If yes, the method proceeds with step 622 during which the four cards are retained, the remaining card is discarded, and one new card drawn, completing a new hand.

Following step 622, the evaluation of the hand is complete, and the method ends.

If, at step 620, the dealer hand being evaluated does not contain four consecutively numbered cards, the method proceeds, referring now to FIG. 6B, with step 624 during which it is determined if the dealer hand being, evaluated contains three cards of the same suit, with those three cards being consecutive in numerical value, except for having at most one break in the sequence, with the break being, at most one numerical value out of sequence, such as 3,4,6 (missing the 5), or 6,7,9 (missing the 8). If yes, the method proceeds with step 622 during which the three cards are retained, the remaining two cards are discarded, and two new cards drawn, completing a new hand. Following step 622, the evaluation of the hand is complete, and the method ends.

If, at step 624, the dealer hand being evaluated does not contain three cards of the same suit, with those three cards being consecutive in numerical value, except for having at most one break in the numerical sequence, the method proceeds with step 628 during which it is determined if the dealer hand being evaluated contains an Ace, a King, a Queen, or a Jack. If yes, the method proceeds with step 630 during which the highest card is retained, the remaining four cards are discarded, and four new cards are drawn, completing a new hand. Following step 630, the evaluation of the hand is complete, and the method ends.

If, at step 628, the dealer hand being evaluated does not contain an Ace, a King, a Queen, or a Jack, the method proceeds with step 632 at which time all five cards in the dealer hand being evaluated are discarded, and five new cards are drawn.

Figure 7:
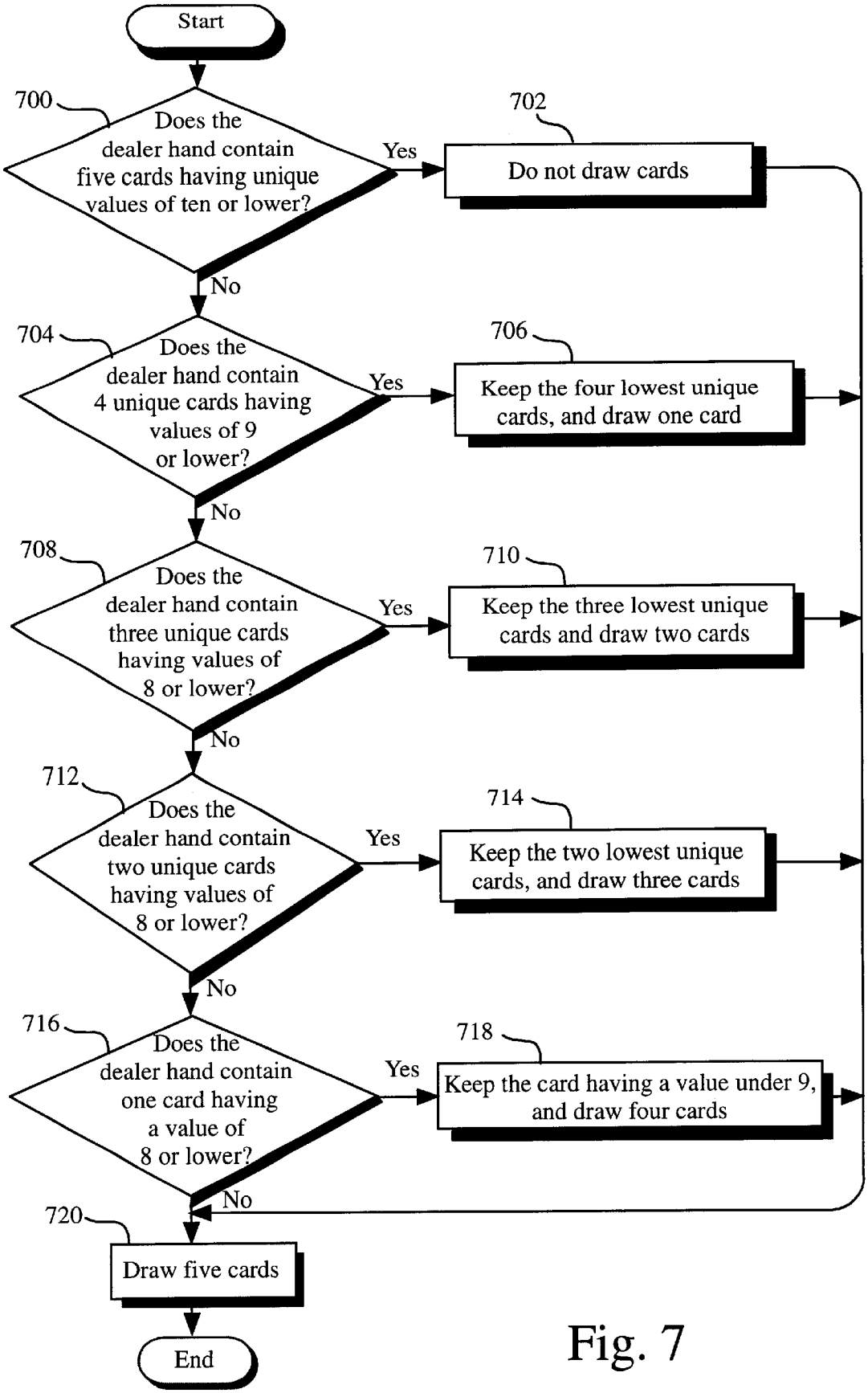
FIG. 7 is a flow chart showing steps in a preferred method for determining the number of cards to be drawn for a give dealer hand when the object of a game is to have a low hand.

FIG. 7 is a flow chart showing steps in a preferred method for determining the number of cards to be drawn for a give dealer hand when the object of a game is to have a low hand.

Referring to FIG. 7, the preferred method of the present invention begins at step 700 when the dealer hand being evaluated is examined to determine whether the dealer hand being evaluated comprises five cards, each having unique (nonpaired) numerical values of 10 or less with respect to each of the other cards in the same dealer hand being evaluated. If yes, the method proceeds at step 702 with a decision to not have the dealer draw any cards for that hand. Following step 702, the evaluation of the hand is complete, and the method ends.

If, at step 700, the dealer hand being evaluated does not comprise five cards, each having unique (nonpaired) numerical values of 10 or less, the method proceeds with step 704 when it is determined if the dealer hand being evaluated contains four cards having unique numerical values of 9 or less. If yes, the method proceeds with step 706 during which the four cards having unique numerical values of 9 or less are retained, the remaining card discarded, and one new card drawn, completing a new hand. Following step 706, the evaluation of the hand is complete, and the method ends.

If, at step 704, the dealer hand being evaluated does not four cards having unique numerical values of 9 or less, the method proceeds with step 708 when it is determined if the dealer hand being evaluated contains three cards having unique numerical values of 8 or less. If yes, the method proceeds with step 710 during which the three cards having unique numerical values of 8 or less are retained, the remaining two cards discarded, and two new cards drawn, completing a new hand. Following step 710, the evaluation of the hand is complete, and the method ends.

If, at step 708, the dealer hand being evaluated does not contains three cards having unique numerical values of 8 or less, the method proceeds with step 712 when it is determined if the dealer hand being evaluated contains two cards having unique numerical values of 8 or less. If yes, the method proceeds with step 714 during which the two cards having unique numerical values of 8 or less are retained, the remaining three cards discarded, and three new cards drawn, completing a new hand. Following step 714, the evaluation of the hand is complete, and the method ends.

If, at step 712, the dealer hand being evaluated does not contains two cards having unique numerical values of 8 or less, the method proceeds with step 716 when it is determined if the dealer hand being evaluated contains one card having a numerical value of 8 or less. If yes, the method proceeds with step 720 during which the card having unique numerical values of 8 or less is retained, the remaining four cards discarded, and four new cards drawn, completing a new hand. Following step 720, the evaluation of the hand is complete, and the method ends.

If, at step 716, the dealer hand being evaluated does not contains one cards having a numerical value of 8 or less, the method proceeds with step 720 when the dealer discards all five cards in the hand being evaluated, and draws five new cards to make a new hand. Following step 720, the evaluation of the hand is complete, and the method ends.

While embodiments and applications of this invention have been shown and described, it would be apparent to those skilled in the art that many more modifications than mentioned above are possible without departing from the inventive concepts herein. The invention, therefore, in not to be restricted except in the spirit of the appended claims.

What is claimed is:

1. A method of playing a Poker card game between a Dealer and at least one player including:

providing at least one deck of conventional playing cards;

selecting a Dealer;

requiring each at least one player to ante a bet before receiving a hand of cards;

dealing cards from said at least one deck to each at least one player and the Dealer so that the Dealer receives two separate and distinct Poker hands and each of the at least one players receives one Poker hand;

permitting each of the at least one player to exercise a betting opportunity;

allowing the players and Dealer to optionally replace at least one playing card in each of their hands followed by a betting opportunity;

evaluating the Poker hand of each player hand and each Dealer hand after all betting is complete according a ranking of Poker hands to determine whether at least one player holds a Poker hand which is ranked higher than both of the Dealer Poker hands; and identifying as a winner any at least one player holding a Poker hand which is ranked higher than both of said Dealer hands and identifying as a nonwinner any at least one player holding a hand ranked lower than either one of the Dealer Poker hands.

2. The method of claim 1 further including:

awarding money to a winning player; and causing a nonwinning player to lose the totality of the nonwinning player's ante and any additional wagers.

3. The method of claim 1 wherein selecting a Dealer comprises selecting as a Dealer a representative of a casino or card room where the method is performed.

4. The method of claim 1 wherein selecting a Dealer comprises selecting a person from said at least one player.

5. The method of claim 1 wherein said ranking of Poker hands comprises a ranking of Poker hands having Royal Flush as the highest hand.

6. The method of claim 1 wherein said ranking of Poker hands comprises a ranking of Poker hands having Five-of-a-Kind as the highest hand.

7. The method of claim 1 wherein said ranking of Poker hands comprises an inverted ranking of Poker hands having a Royal Flush as the lowest hand.

8. The method of claim 1 wherein said ranking of Poker hands comprises an inverted ranking of Poker hands having a Five-of-a-Kind as the lowest hand.

9. The method of claim 1 further including allowing, following said permitting, a particular one of said at least one player to raise his bet only if said particular one of said at least one player has not previously chosen an option to not bet at any time while the present hand was being played.

10. The method of claim 1 wherein, within said awarding, the amount of money awarded to the player is the total of the player's ante and all the subsequent wagers.

11. The method of claim 1 wherein, within said awarding, the amount of money awarded to a given winning player is the amount all wagers that given winning player has made after the ante.

12. The method of claim 1 wherein the minimum bet a player may make in said permitting is the size of that player's ante.

13. The method of claim 1 wherein the maximum bet a player may make in said permitting is twice the size of the ante.

14. The method of claim 1 wherein the size of the maximum bet changes at for successive instances of said permitting.

15. The method of claim 1 wherein the size of the minimum bet changes at for successive instances of said permitting.

16. The method of claim 1 further including determining, based upon the results of said evaluation, whether a specific one of the at least one player to be a winner if the specific one of the at least one player holds a hand which is ranked lower than both of said Dealer hands.

17. A method of playing a Poker card game between a Dealer and at least one player including:

providing at least one deck of conventional playing cards;

selecting a Dealer;

requiring each at least one player to ante a bet before receiving a hand of cards;

dealing cards from said at least one deck to each at least one player and the Dealer so that the Dealer receives two separate and distinct Poker hands and each at least one player receives one Poker hand;

permitting each at least one player to exercise a betting opportunity;

adding at least one more card to each player hand and each Dealer hand at least once and then allowing each at least one player to exercise a betting opportunity after each instance of adding at least one more card to each player hand and each Dealer hand;

evaluating the Poker hands of each at least one player and each Dealer after all betting is complete according a ranking of Poker hands to determine whether at least one player holds a Poker hand which is ranked higher than both of the Dealer Poker hands;

identifying as a winner any at least one player holding a Poker hand which is ranked higher than both of the Dealer Poker hands and identifying as a nonwinner any at least one player holding a Poker hand ranked lower than either one of the Dealer Poker hands;

awarding money to a winning player; and causing a nonwinning player to lose the totality of the nonwinning player's ante and any additional wagers.

18. The method of claim 17 further including:

awarding money to a winning player; and causing a nonwinning player to lose the totality of the nonwinning player's ante and any additional wagers.

19. The method of claim 17 wherein selecting a Dealer comprises selecting as a Dealer a representative of a casino or card room where the method is performed.

20. The method of claim 17 wherein selecting a Dealer comprises selecting a person from said at least one player.

21. The method of claim 17 wherein said ranking of Poker hands comprises a ranking of Poker hands having Royal Flush as the highest hand.

22. The method of claim 17 wherein said ranking of Poker hands comprises a ranking of Poker hands having Five-of-a-Kind as the highest hand.

23. The method of claim 17 wherein said ranking of Poker hands comprises an inverted ranking of Poker hands having a Royal Flush as the lowest hand.

24. The method of claim 17 wherein said ranking of Poker hands comprises an inverted ranking of Poker hands having a Five-of-a-Kind as the lowest hand.

25. The method of claim 17 further including allowing, following said permitting, a particular one of said at least one player to raise his bet only if said particular one of said at least one player has not previously chosen an option to not bet at any time while the present hand was being played.

26. The method of claim 17 wherein, within said awarding, the amount of money awarded to the p layer is the total of the player's ante and all the subsequent wagers.

27. The method of claim 17 wherein, within said awarding, the amount of money awarded to a given winning player is the amount all wagers that given winning player has made after the ante.

28. The method of claim 17 wherein the minimum bet a player may make in said permitting is the size of that player's ante.

29. The method of claim 17 wherein the maximum bet a player may make in said permitting is twice the size of the ante.

30. The method of claim 17 wherein the size of the maximum bet changes at for successive instances of said permitting.

31. The method of claim 17 wherein the size of the minimum bet changes at for successive instances of said permitting.

32. The method of claim 17 further including determining, based upon the results of said evaluation, whether a specific one of the at least one player to be a winner if the specific one of the at least one player holds a hand which is ranked lower than both of said Dealer hands.

* * * * *